United States Patent [19]

Estabrooks

[11] 4,252,453

[45] Feb. 24, 1981

[54] ACOUSTIC ATTENUATOR SYSTEM FOR QUIETIZING PRINTERS AND THE LIKE

[75] Inventor: David A. Estabrooks, Andover, Mass.

[73] Assignee: Centronics Data Computer Corp., Hudson, N.H.

[21] Appl. No.: 898,419

[22] Filed: Apr. 20, 1978

[51] Int. Cl.[3] ..... B41J 29/02

[52] U.S. Cl. ..... 400/690.1; 400/613.2; 400/625; 181/201

[58] Field of Search ..... 400/613.2, 613.3, 613.4, 400/689, 690, 690.1, 690.2, 690.3, 690.4, 625; 181/201; 226/74

[56] References Cited

U.S. PATENT DOCUMENTS

| | | | |
|---|---|---|---|
| 1,749,177 | 3/1930 | Baxter et al. | 181/201 X |
| 2,241,797 | 5/1941 | Weidner | 400/690.2 X |
| 3,087,578 | 4/1963 | Reed et al. | 181/201 |
| 3,308,919 | 3/1967 | Cunningham | 400/690 |
| 3,476,210 | 11/1969 | Carlson | 400/690.2 X |
| 3,513,938 | 5/1970 | Buehner et al. | 400/690.1 X |
| 3,747,735 | 7/1973 | Frick | 400/690.2 |
| 3,930,601 | 1/1976 | Masuda | 226/74 |

OTHER PUBLICATIONS

IBM Technical Disclosure Bulletin, "Silent Paper Holder", Brehm, vol. 17, No. 7, Dec. 1974, pp. 1906–1907.

*Primary Examiner*—Ernest T. Wright, Jr.
*Attorney, Agent, or Firm*—Weinstein & Sutton

[57] ABSTRACT

Apparatus for attenuating noise necessarily emitted from output slots of a printer mechanism enclosure and utilizing a minimal amount of enclosure components of significantly reduced size. Input and output housings or compartments for noise attenuation are provided, each of which form elongated narrow guideways. One end of each of the guideways of each of said compartments is aligned with the paper input and output slots, respectively, of the printer mechanism housing and is sealed to prevent noise at the juncture. The guideways have narrow passageways extending therethrough, but are sufficiently wide to permit the paper passing therethrough to move without experiencing any drag resistance due to the presence of the guideways. At least one surface of the guideways confronting and substantially parallel to the moving paper web is lined with a suitable noise attenuating foam. Each guideway is of a length sufficient to provide a significant reduction in noise level at the outlet ends of the guideways as compared with the noise levels at the inlet and outlet slots of the printer mechanism housing in the absence of the noise attenuators.

The attenuators are adapted to be easily removable in order to service and maintain both the attenuators and the printer as well as to facilitate insertion of fresh paper.

30 Claims, 11 Drawing Figures

ACOUSTIC ATTENUATOR SYSTEM FOR QUIETIZING PRINTERS AND THE LIKE

BACKGROUND OF THE INVENTION

One of the major factors in present day printer mechanisms is the desire for ever increasing operating speeds. One of the accompanying disadvantages occurring in printers, especially of the impact type, is the ever increasing noise occurring during printing. For example, considering high-speed band printers of the impact type, a closed loop band having two or more sets of alphabetic and numeric characters moves in a direction transverse to the direction of feed of a paper web, and a large plurality of hammers, typically equal in number to the number of characters per line which the printer is capable of printing, are capable of being independently and selectively triggered to impact a raised character on the band against an inked ribbon and the paper web to form characters on the paper web. Obviously, the large number of hammers utilized and the extremely fast operating speeds yield a printer capable of high-speed printing operations, typically of the order of 600 lines per minute or greater, with 132 characters per line, but also having the disadvantage of creating noise which is both annoying and distracting to the equipment operators. Obviously, as the number of printers within a room increases, the noise significantly increases adding to printing capability and, unfortunately, adding to the annoyance and distraction created by the printers.

The noise generated by printer mechanisms is airborne to the user or operator. The conventional method for preventing noise from reaching the operators is to completely enclose the printer, including the means for paper handling and stacking, with a large cabinet.

The large cabinets or enclosures which are required further include doors and windows which must be made airtight to prevent the escape of undesirable noise. The doors and windows are required to permit necessary observation and to permit easy removal and replacement of paper for use by the printer. Since the smallest openings in such housings cause the noise level to increase markedly, this type of cabinet, in addition to being quite large in size, tends to be costly to manufacture, not only due to the amount of materials required, but also due to the extreme care which must be exercised to make all openings noise tight.

Such cabinets must also be lined with materials such as foam having good acoustical attenuation properties to prevent sound reverberation within the enclosure which would otherwise lead to transmission through the walls of the cabinet. To date, very little of the noise is attenuated in cabinet designs of this type, requiring airtight doors, windows and the like to keep airborne noise from escaping to the exterior of the cabinet.

It is, therefore, both a serious and important problem to be able to provide attenuating means to reduce noise to more acceptable levels while at the same time minimizing the amount of cabinetry necessary to achieve the desired results.

BRIEF DESCRIPTION OF THE INVENTION

The present invention is characterized by providing a new and yet highly simplified design which eliminates the need for large, expensive acoustically lined cabinetry. These most desirable objectives are accomplished in part by using a small enclosure which substantially tightly encloses the printer mechanism with a minimum clearance. The enclosure is lined with an acoustic foam material so that some of the noise is attenuated by the close proximity of the foam material relative to the printer mechanism which is generating the annoying noise. However, most of the noise remains airborne and is conveyed to the exterior of the enclosure through the paper slot openings which must necessarily be provided in the printer mechanism enclosure. In addition thereto, the sound is amplified by the paper motion through the printer inlet and outlet openings or paper slots.

Consequently, the most important object of the new design described herein is to substantially reduce the noise from the paper slot openings. This most desirable objective is accomplished by two simple and yet low-cost acoustic attenuators, one such attenuator being provided for reducing noise emitted from the inlet slot, while the remaining attenuator reduces noise airborne through the outlet paper slot.

The basic concept of both noise reduction devices resides in the employment of an enclosure having a guideway causing the paper to travel therethrough so that the paper travel is confined to the enclosure guideway which is designed to have a high impedance to airborne sound. This is accomplished by providing an enclosed narrow guideway which has a length measured in the direction of paper travel which is of the order of 10 to 14 inches and preferably in a preferred range of 11 to 13 inches. The walls of the attenuator are preferably in close proximity to the paper surface in order to effectively attenuate sound, the spacing preferably being within the range of from $\frac{1}{4}$ inch to 1 inch and preferably within the range of from $\frac{1}{4}$ inch to $\frac{5}{8}$ inch. At least one wall is lined with an acoustic foam material for absorbing noise along the path of paper movement. The material should preferably be of a thickness of the order of $\frac{1}{4}$ to $1\frac{1}{4}$ inches and most preferably be within the range from $\frac{3}{8}$ to 1 inch thick, it being understood that the guideway for paper passage is measured from the surface of the foam confronting the paper, not from the enclosure members forming the noise attenuator. The sides of the attenuator embracing the side edges of the paper web are closed off and substantially tight to prevent sound from escaping therethrough before the noise level is reduced at the outlet ends of the attenuators.

The noise attenuator utilized for the printer mechanism inlet slot is designed to cooperate with the fanfold paper supply box and is adapted to cover the top open end of the box as well as being provided with side walls which extend downwardly in a telescoping manner to provide a noise tight seal in addition to the elongated noise attenuating guideway formed by the input attenuator and extending between the paper supply box and the printer mechanism housing inlet opening.

The design of the attenuators permit their easy removal and replacement for inspection and maintenance purposes as well as to facilitate removal and insertion of a paper web.

BRIEF DESCRIPTION OF THE FIGURES AND OBJECTS OF THE INVENTION

Therefore, one object of the present invention is to provide a noise attenuator for printer housings and the like which comprise narrow elongated guideways having one end thereof communicating with a paper slot in the printer mechanism housing, having at least one noise attenuating surface treatment confronting the paper moving through the guideway, and being of a length sufficient to significantly attenuate the noise airborne at the outlet end of the guideway.

Still another object of the present invention is to provide a noise attenuator of the type described hereinabove for both the paper inlet and paper outlet slots of the printer mechanism housing.

Still another object of the present invention is to provide noise attenuator structures of the character described hereinabove and further utilizing a printer mechanism housing which substantially tightly encloses the printer mechanism with minimal clearance and which is lined with acoustic foam so as to keep the acoustic foam as close as possible to the printer mechanism for attenuating noise within the enclosure.

Still another object of the present invention is to provide a novel acoustic attenuator cooperating with the paper inlet slot of a printer mechanism housing to provide a narrow guideway for travel therethrough, wherein one end of the guideway communicates with the paper slot while the other end of said guideway communicates with a paper supply enclosure. The attenuator further is adapted to cover the paper supply enclosure, and to reduce noise which is airborne from the printer to a place external of the enclosure so as to reduce the noise which is airborne to operators to more acceptable levels.

Still another object of the present invention is to provide novel noise attenuators for use with printer mechanism housings and the like, which attenuators are designed to be easily and simply removable and replaceable upon the printing structure to facilitate their inspection and maintenance, as well as to facilitate removal and replacement of paper.

The above, as well as other objects of the present invention, will become apparent when reading the accompanying description and drawing in which:

FIGS. 1 and 1*a* show simplified perspective and elevational views of the printer and having the noise attenuators of the present invention mounted thereon.

FIGS. 2*a*, 2*b* and 2*c* show side, front and top views, respectively, of the paper inlet attenuator of FIG. 1.

Figure 1:
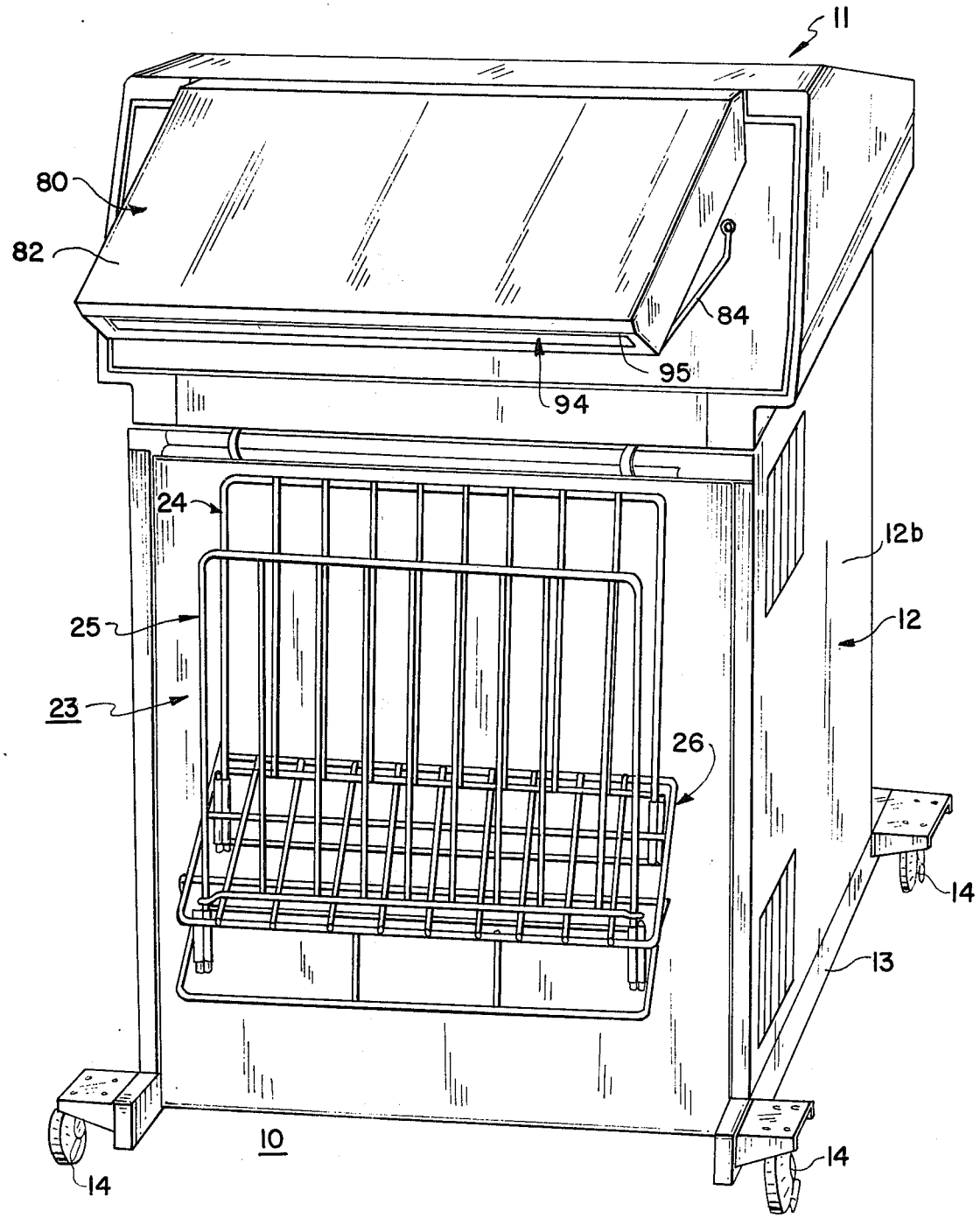
Figure 4:
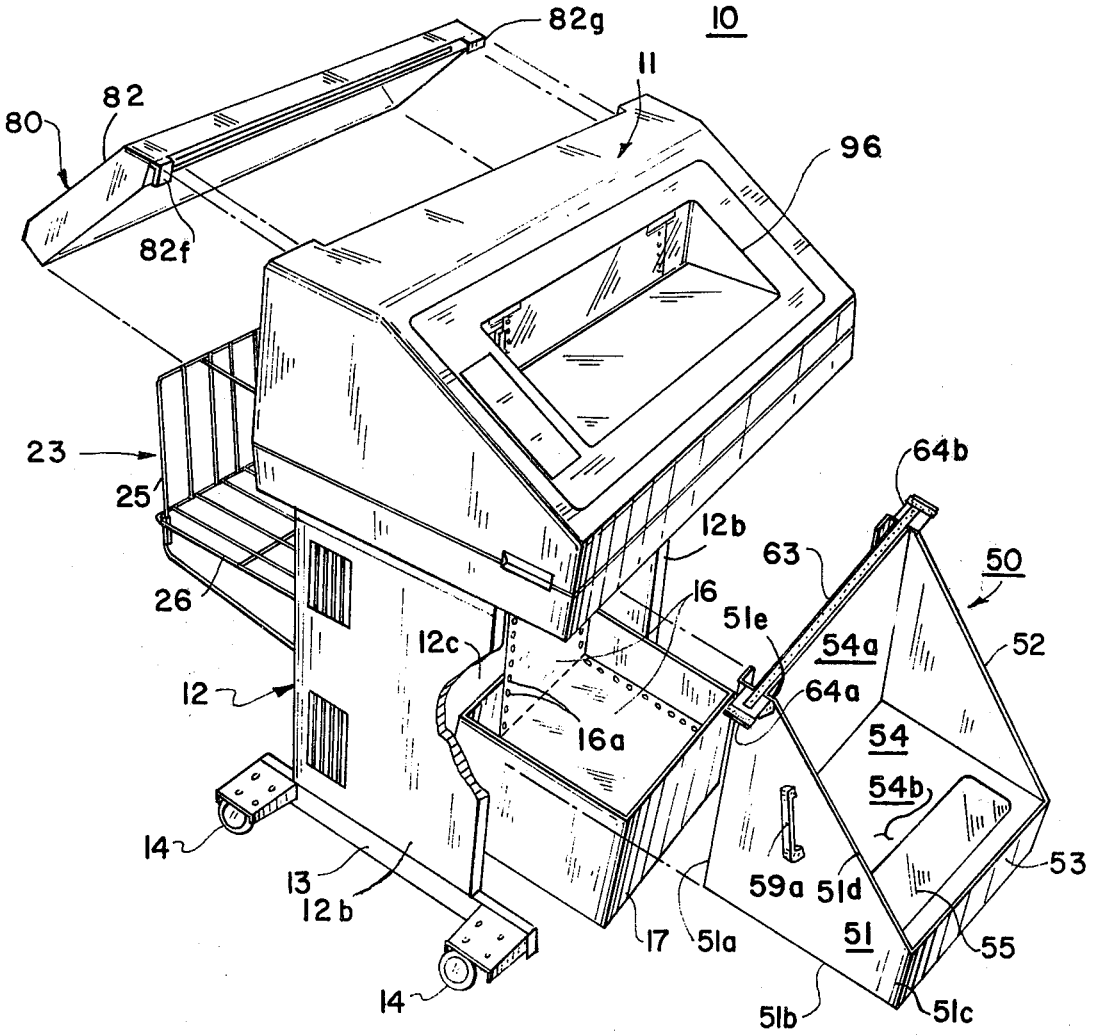
FIG. 4 shows a three-quarter exploded perspective view of the noise attenuators and printer with both the paper inlet and paper outlet attenuators shown displaced from their normal mounting positions.
Figure 5A:
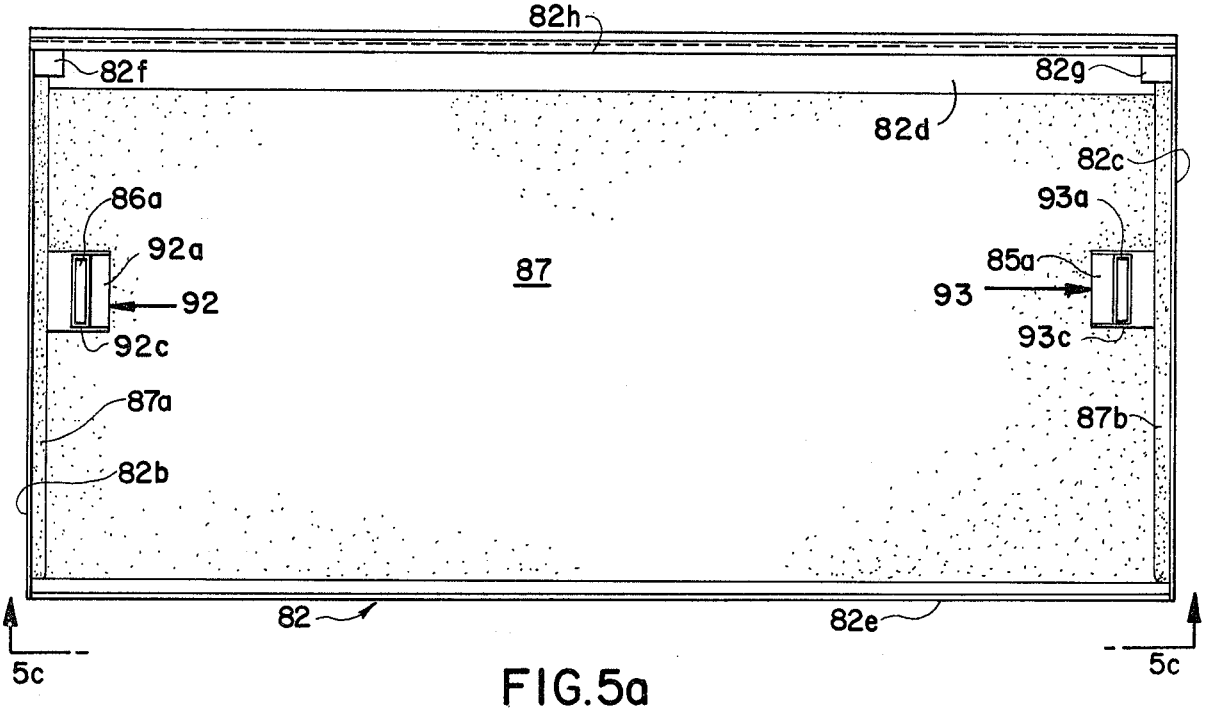
Figure 5C:
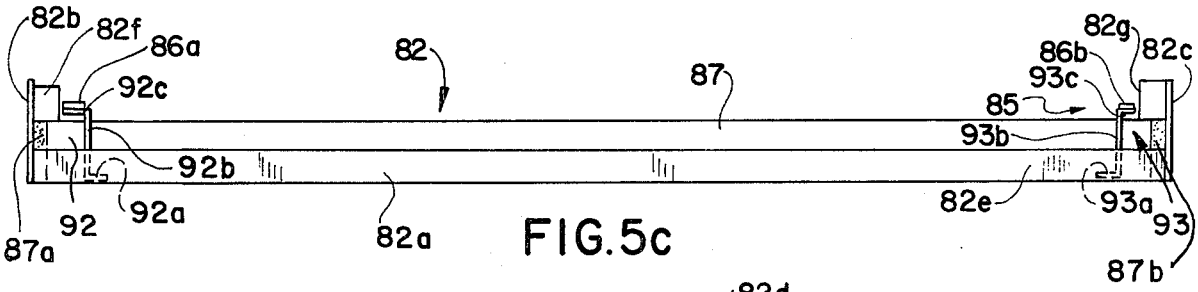
Figure 5B:
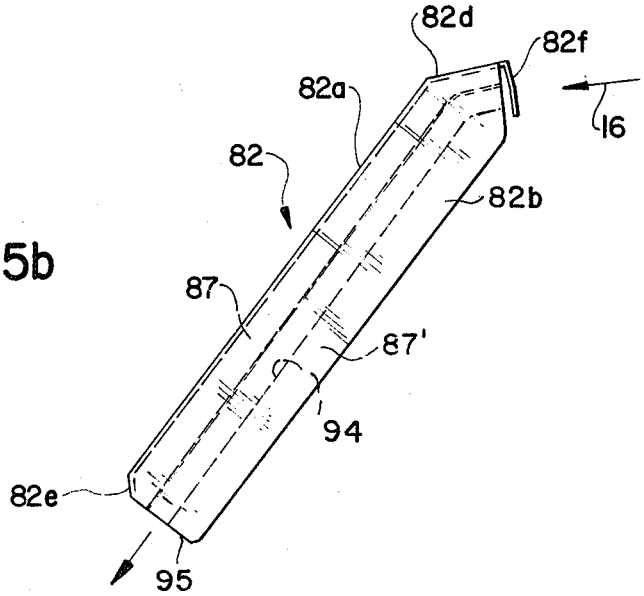

FIGS. 5*a*, 5*b* and 5*c* show bottom, side and front views, respectively of the paper outlet attenuator of FIGS. 1 and 4.

Figure 6:
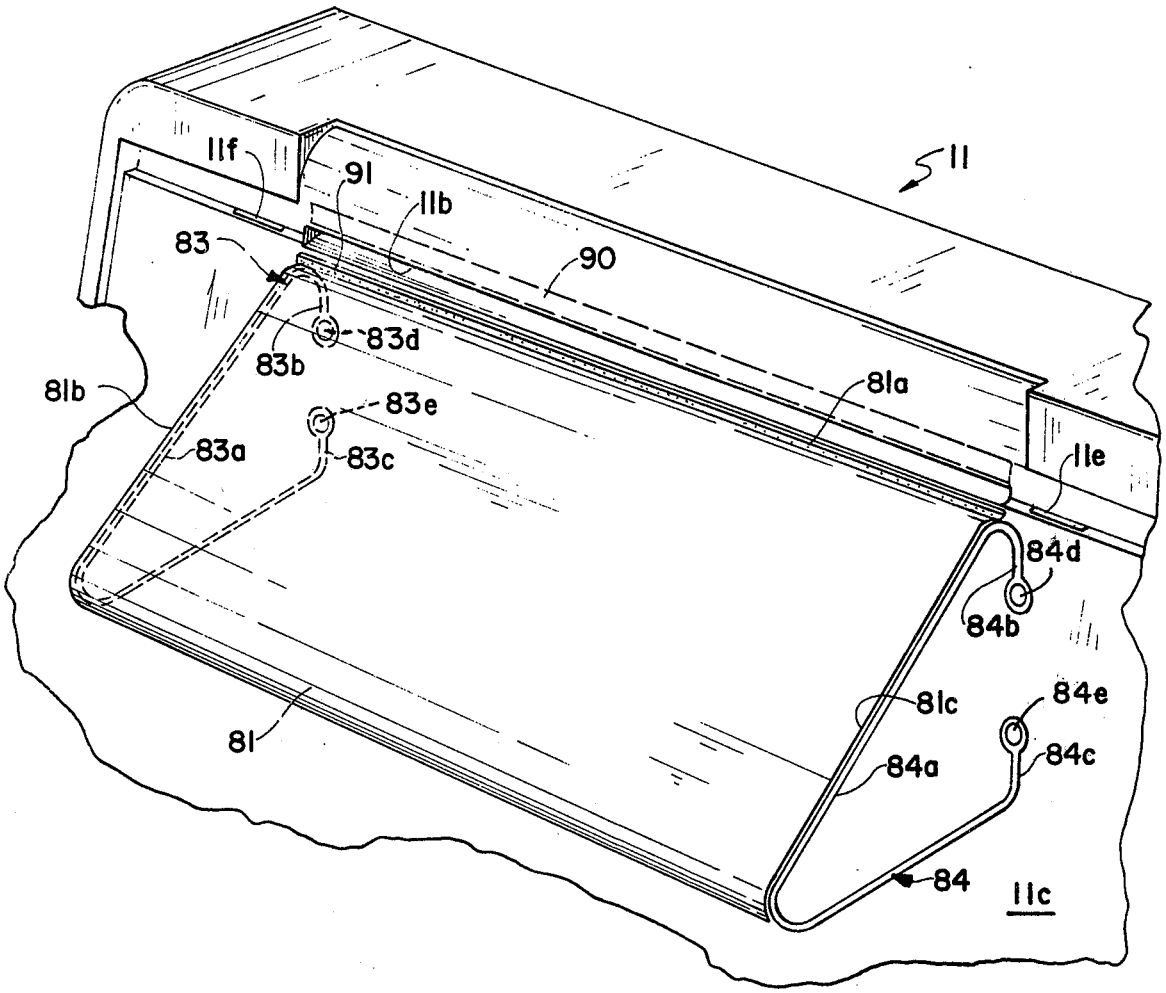

FIG. 6 shows a three-quarter perspective of the assembly forming the lower side of the paper outlet attenuator and showing a portion of the printer rear housing surface upon which the aforesaid assembly is mounted.

DETAILED DESCRIPTION OF THE INVENTION

Figure 1A:
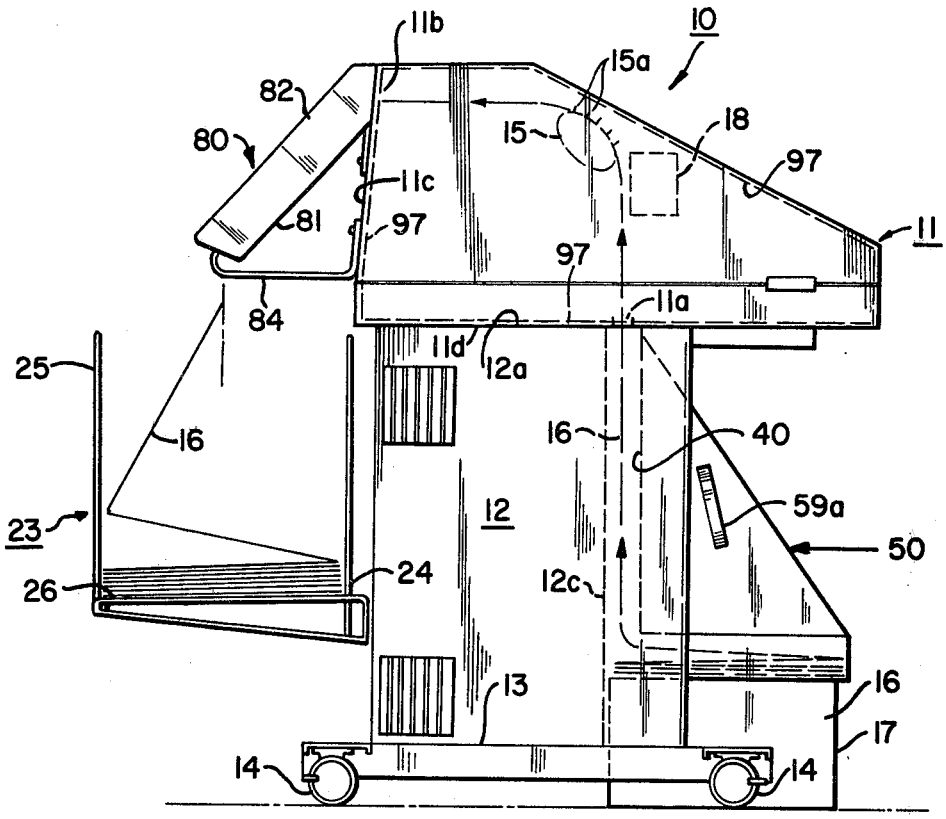
Figure 3:
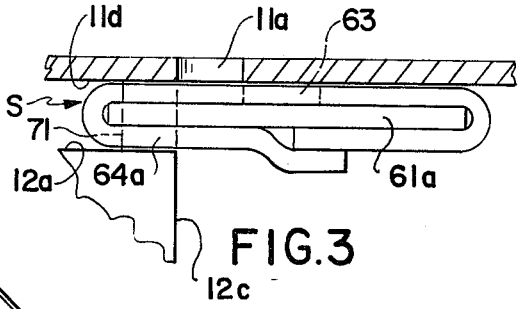
FIG. 3 shows a detailed view of the foam strips arranged around the inlet paper slot provided in the bottom of the printer housing shown in FIG. 1, and is useful in describing the manner in which the jointure between the paper inlet attenuator and the paper inlet slot is noise-tightly sealed.
Figure 2B:
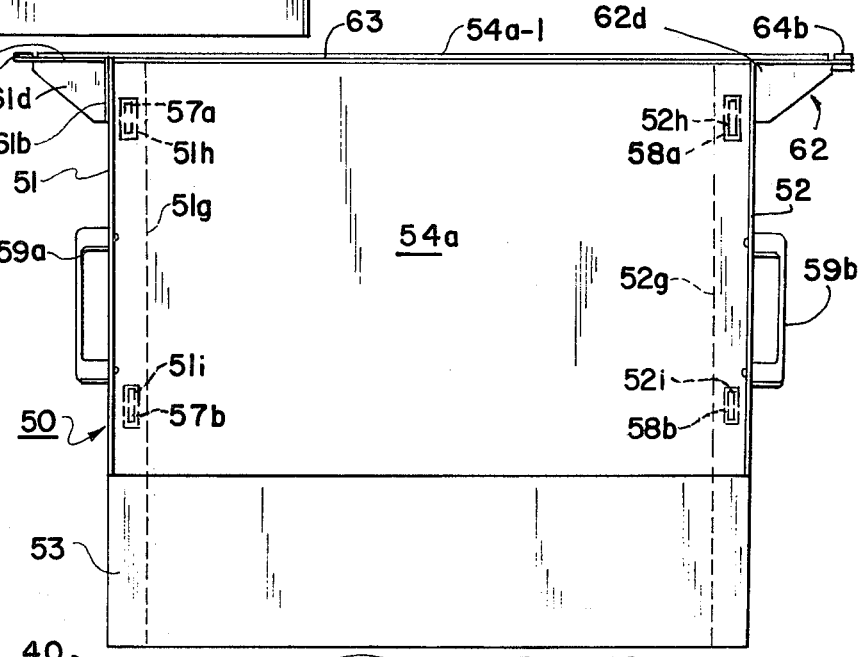
Figure 2C:
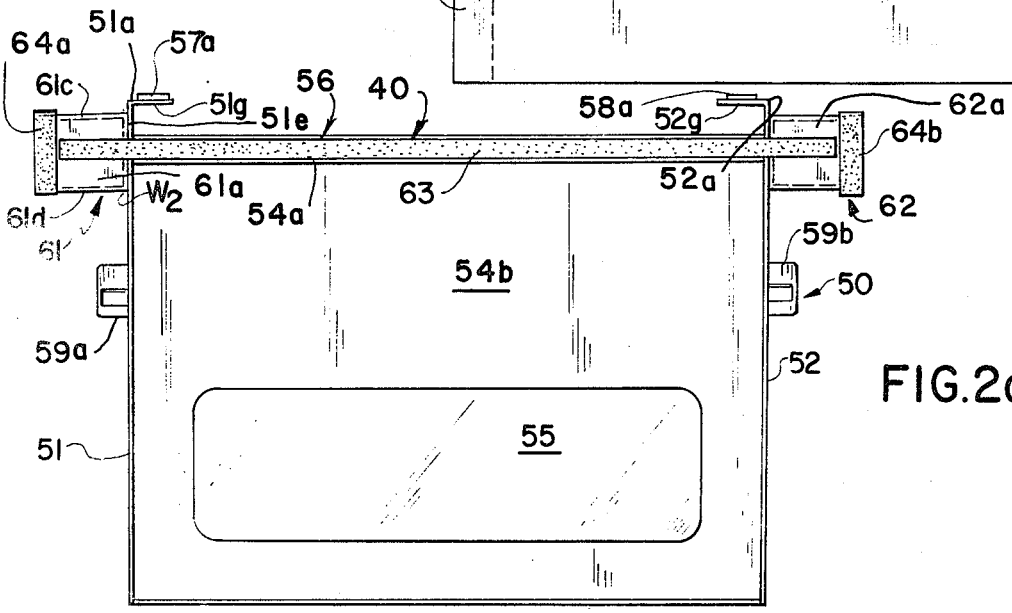

FIGS. 1, 1*a* and 4 show a printer system 10 utilizing the paper inlet and paper outlet attenuators 50, 80 of the present invention and being comprised of a printer mechanism enclosure or housing 11 having a paper inlet slot 11*a* (FIG. 3), and a paper outlet slot 11*b* (FIG. 6), the housing 11 being mounted upon a printer stand 12 comprised of upright sides 12*b* and vertical wall 12*c* supported upon support rails 13, the ends of which are provided with castors 14 to facilitate movement and orientation of the printer relative to equipment interfaced therewith, such as, for example, a computer or a communications network.

The printer is designed to print at high speeds and is provided with a printing mechanism 18 (see FIG. 1*a*) which may, for example, be a band-type printer comprised of a closed loop band typically having two or more sets of alphabetic and numeric characters arranged along the band and provided with a plurality of hammers arranged transverse to the direction of paper movement through the printer and adapted to be independently and selectively energized to form characters on the paper web 16 moving through the printer. One typical printer which may be utilized with the noise attenuators 50, 80 of the present invention to great advantage is the Centronics Series 6000 band printer.

As shown in FIGS. 1*a* and 4, the paper 16 is preferably arranged in fanfold or accordian pleated fashion and is neatly stored within a paper supply box 17. Typically, the paper 16 is an elongated web of indeterminate length which is provided with linearly lined perforations uniformly spaced and arranged in parallel fashion and extending across the width of the web 16 to facilitate the fanfold arrangement as well as facilitating separation of the web 16 into a plurality of sheets of uniform dimension.

The paper web 16 is preferably provided with apertures 16*a* arranged along the opposite longitudinal sides of the web 16 and spaced equidistant from one another so as to be positively and rapidly advanced from the paper supply box 17 and through the printer by tractor assemblies 15 (see FIG. 1*a*) which are conventionally employed for advancing such paper webs, one such tractor assembly being described in U.S. Pat. No. 3,930,601, issued Jan. 6, 1976 and assigned to the assignee of the present invention.

The paper 16, after being printed upon, is advanced by the pins 15*a* of tractor assemblies 15 so as to exit through the printer mechanism enclosure paper outlet slot 11*b* and thereby pass through the paper outlet attenuator 80 to be more fully described hereinbelow.

The paper outlet attenuator 80 guides the paper sheets diagonally downward and away from the printer mechanism housing 11 and, specifically, the housing rear wall 11*c* where the paper 16 experiences free fall or, in other words, is free from engagement by any guiding member between the lower end of the paper outlet attenuator 80 and a paper basket 23 having side walls 24 and 25 and a floor 26 adapted to support and neatly stack the paper web 16 in the original fanfold fashion.

Although the arrangement shown, for example, in FIG. 1 is adapted to handle fanfold paper, it should be understood that the attenuators 50, 80 of the present invention are equally useful with and adapted to handle paper in other forms such as paper which may be arranged in large rolls, there being no special adjustments or alterations required to be made to the paper inlet and paper outlet attenuators 50, 80 to handle such webs, as will be more obvious from the ensuing description set forth herein.

The paper inlet attenuator 50 is adapted to provide an effective noise reducing cover for the paper supply box 17, the attenuator 50 having a cover member 54*b* which rests upon the open end of the paper supply box 17 and having side walls 51, 52 which telescopingly cooperate with the side walls of the paper supply box 17 to further attenuate and reduce the escape of noise from the printer mechanism system 10, said system including the printer mechanism 18, its housing 11, and the inlet and outlet paper attenuators 50, 80, respectively.

The paper inlet attenuator 50 cooperates with one vertical wall 12*c* of the printer stand 12 to form a narrow guideway 40 extending between the upper end of the paper supply box 17 and the paper inlet slot 11*a*. The guideway 40 has at least one surface treatment along one surface thereof of a suitable noise attenuation material such as, for example, an acoustic foam 69 so that the noise attenuation characteristics of the foam material and the length of the guideway 40, accompanied by the further noise attenuating cover member 54*b* over the paper supply box 17 significantly reduces noise which is airborne to the operator to levels which are much more acceptable and which do not distract the operator.

The paper inlet attenuator 50 is provided with a pair of handles 59*a*, 59*b* to facilitate gripping, placement and removal thereof relative to the printer mechanism 18 and paper supply box 17.

The paper outlet attenuator 80 comprises a lower paper guide extender sheet 81 which, together with the attenuator cover member 82, cooperatively forms a narrow guideway 94 of suitable length, which guideway 94 extends between the paper outlet slot 11*b* and the outlet end 95 of the paper outlet attenuator 80 to move the paper 1*b* diagonally downward and away from the rear surface 11*c* of the printer mechanism enclosure 11 to enable the paper 16 to be neatly stacked in fanfold fashion (or rolled up if desired) after completion of the printing operation.

The paper outlet attenuator 80 is similarly provided with at least one acoustic attenuation surface treatment along one surface thereof, said treatment preferably being a sheet of acoustic foam 87 covering substantially the entire length and width of the guideway 94 to absorb and attenuate sound which would otherwise be airborne from the paper outlet slot 11*b* to the operator so as to reduce the sound level at the outlet end 95 of the guideway 94 to a much more acceptable level.

Considering the paper inlet attenuator 50 in more detail, and specifically FIGS. 2*a*–2*c* and 4, the paper inlet attenuator 50 is comprised of a pair of vertically aligned side walls 51 and 52, substantially identical in size and design. Therefore, only side wall 51 will be described herein, it being understood that side wall 52 is the mirror image thereof.

Side wall 51 has a vertically aligned edge 51*a*, a bottom edge 51*b*, and a vertically aligned outer edge 51*c*. A diagonally aligned edge 51*d* joins with the horizontally aligned edge 51*e* which also joins with the vertically aligned inner edge 51*a*.

An outer front piece 53 extends across the front of the paper inlet attenuator 50 spanning between side walls 51 and 52. A large sheet 54 is bent into an L-shaped configuration so as to form a vertically aligned portion 54*a* and a horizontally aligned portion 54*b*, said L-shaped sheet 54 extending between the interior surfaces of side walls 51 and 52. Sheet portion 54*a* can be seen to be arranged a spaced parallel distance inwardly from the inner vertical edges 51*a* and 52*a* of side walls 51 and 52 and serves to form the guideway 40 passage to be described more fully hereinbelow.

Sheet portion 54*b* serves to form the cover member over the paper supply box 17 and is provided with a rectangular shaped opening designed to receive transparent window 55 which enables the operator to examine the contents of paper supply box 17 without removal of the paper inlet attenuator 50.

Figure 2A:
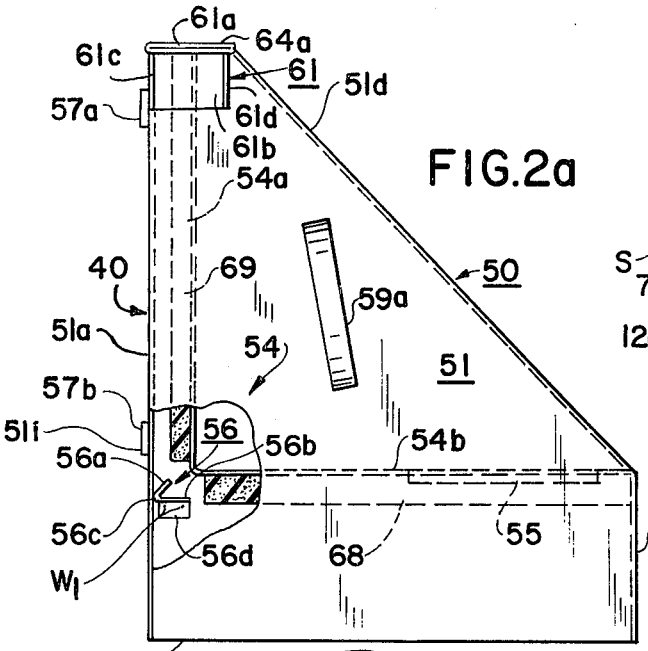

A metallic sheet 56 spans between side walls 51 and 52 and is bent along its entire length to form a substantially J-shaped sectional configuration to define a flange 56*a* which joins with the main portion 56*b* of sheet 56 along a curved section 56*c* which serves as a guiding edge for the paper web 16 in a manner to be more fully described. The ends of the sheet 56 are bent downwardly to form a pair of joining flanges 56*d* (only one of which is shown in FIG. 2*a*) which are secured by weldments such as weldment $W_1$ to the interior surfaces of paper inlet attenuator side walls 51 and 52.

The side walls 51 and 52 are bent inwardly to form a pair of flanges 51*g*, 52*g*, which flanges are provided with elongated slots 51*h*, 52*h*, and 51*i*, 52*i* adapted to receive permanent magnet assemblies 57*a*, 58*a* and 57*b*, 58*b* which are magnetically attractive to one surface 12*c* (see FIG. 1*a*) of the printer stand 12, releasably securing the paper inlet attenuator 50 to the printer stand 12 in a manner to be more fully described.

The side walls 51 and 52 are each provided with a handle 59*a* and 59*b*, respectively, to facilitate the handling of the paper inlet attenuator 50 for removal and replacement.

A pair of bracing bracket assemblies 61 and 62 are joined to the upper ends of side walls 51 and 52. Since both of these bracing brackets 61, 62 are substantially mirror images of one another, only bracket 61 will be described herein for purposes of simplicity. Bracing bracket 61 is comprised of an upper sheet member 61*a*, a vertically aligned sheet member 61*b* and a pair of gusset-shaped sides 61*c* and 61*d*. The vertical sheet member 61*b* is joined to side wall 51, preferably by weldments such as $W_2$. The top surface of upper sheet member 61*a* is flush with the top edge of side wall 51 as well as the top edge 54*a*-1 of sheet portion 54*a*. An elongated strip 63 spans across the top of bracing brackets 61 and 62 as well as the top edges of side walls 51 and 52 and sheet portion 54*a*.

The top surface of attenuator 50 is provided with elongated strip 63 of an acoustic resilient foam material and side strips 64*a* and 64*b* of the same material wrapped around the free edges of upper sheet members 61*a* and 62*a* and running substantially perpendicular to elongated strip 63. The free edges of upper sheet members 61*a* and 62*a* of supporting brackets 61 and 62 which extend beyond the gussets 61*d* and 62*d*, respectively, are slidably received within narrow slots S formed between the upper edges 12*a* of the opposite printer stand upright sides 12*b* and the bottom surface 11*d* of printer mechanism enclosure 11 (these portions of the printer stand 12 and printer mechanism enclosure 11 being partially shown in FIG. 3) which slidably receive the aforementioned edges and thereby serve to releasably supportably mount the paper inlet attenuator 50 to the printer assembly 10, said assembly 10 in this case comprising the printer mechanism enclosure 11 and printer stand 12.

The paper inlet attenuator 50 is further releasably joined to the printer assembly 10 by means of the aforementioned magnet members 57*a*, 57*b* and 58*a*, 58*b* magnetically attracted to the metallic vertical wall 12*c* of the printer stand 12. The upper edge 12*a* of surface 12*c* is positioned immediately beneath the lower surface 11*d* of the printer mechanism enclosure 11 and is positioned just to the left of one edge of the paper inlet slot 11*a*, relative to the arrangement shown in FIG. 3.

Sheet portion 54*b* of sheet 54 rests upon the edges of the side walls of paper supply box 17 to substantially form a "lid" therefor. The portions of side walls 51 and 52 extending below the portion 54*b* and the front wall 53 cooperate with the printer stand vertical wall 12*c* to substantially form four side walls which embrace four side walls of the paper supply box 17, the side walls 51, 52 and front wall 53 of the paper attenuator 50 substantially telescopingly cooperating with the three associated side walls of the paper supply box 17 to further reduce the amount of noise which may leave the paper supply box 17 and enter into the atmosphere external to the printer system 10, the system 10 in this case incorporating the printer mechanism enclosure 11, stand 12, paper inlet attenuator 50, and paper supply box 17.

The system 10 is adapted to accommodate fanfold paper 16 of either the American or European size wherein the width of the paper supply box 17 will be a first length which is at least slightly greater than the length of American paper (11 inches) or a second length which is typically great enough to accommodate European paper (12 inches), so as to be stacked neatly within the paper supply box 17. Thus, the paper inlet attenuator 50 is designed to telescopingly receive the three side walls of the paper supply box 17 associated with side walls 51 and 52 and front wall 53 of the paper inlet attenuator 50 so as to provide a gap therebetween sufficient to accommodate supply boxes of different dimensions. The gap between the cooperating side walls 51, 52 of the paper inlet attenuator 50 and paper supply box 17 should preferably be in the range of from $\frac{1}{4}$ to $\frac{3}{4}$ inches and in the more preferred range of from $\frac{3}{8}$ to $\frac{5}{8}$ inches.

The fanfold paper 16 is lifted upwardly from the paper supply box 17 and is guided about the curved section 56*c* of guide sheet member 56 so as to move upwardly and into the inlet paper slot 11*a*.

The bottom surface of sheet portion 54*b* and the left-hand surface of sheet portion 54*a* confronting the guideway 40 (see FIGS. 1*a* and 2*a*) are preferably provided with a sound attenuating treatment which, in the preferred embodiment, is comprised of an acoustic foam sheet 68 and 69, respectively, which acoustic foam sheets 68, 69 may have a surface confronting the guideway 40 and forming one surface thereof so as to be adapted to absorb and attenuate sound. The acoustic foam sheets 68, 69 may, for example, be of any suitable foam material and further, for example, the surface confronting guideway 40 may be textured, roughened, dimpled, or corrugated so as to provide an undulating surface to further enhance and improve noise attenuation. The foam sheets 68, 69 are preferably of a thickness of the order from $\frac{1}{4}$ to $1\frac{1}{4}$ inches thick, and in the more preferred range from $\frac{3}{8}$ to $1\frac{1}{8}$ inches thick. The most preferred range is $\frac{1}{2}$ to 1 inch thick foam material. The length of the guideway 40 extending between the paper inlet slot 11*a* and curved section 56*c* is 6 to 18 inches and the more preferred range is from 9 to 15 inches, and the most preferred range from 10 to 14 inches.

Although the paper inlet attenuator 50 has been described as having only a single acoustic foam sheet 69 confronting and defining the guideway 40, it should be understood that the front surface of the upright surface 12*c* of stand 12 may likewise be provided with an acoustic foam sheet (not shown) arranged and cooperating with acoustic foam sheet 69 so as to form a guideway passage of sufficient gap distance. The gap distance, regardless of whether one or two acoustic foam sheets are employed is preferably in a range from $\frac{1}{4}$ to $\frac{3}{4}$ inches, in the more preferred range from $\frac{3}{8}$ to $\frac{5}{8}$ inches, and the most preferred range from 7/16 to 9/16 inches.

The effectiveness of the paper inlet attenuator 50 is enchanced by noise tightly sealing the region between the upper end of paper inlet attenuator 50 and paper inlet slot 11*a*. As shown best in FIG. 3, one side strip 64*a* is shown arranged along one end of the elongated paper inlet slot 11*a*, while the elongated strip 63 is shown as being aligned just to one side of paper inlet slot 11*a* and extending the length of the slot 11*a*. It should be understood that strip 64*b* (note, for example, FIG. 4) serves to noise-tightly seal the opposite edge of paper inlet slot 11*a*. An additional piece of acoustic foam strip 71 is arranged between the opposite longitudinal edge of paper inlet slot 11*a* and the top edge 12*a* of surface 12*c* of the printer stand 12 so as to completely noise-tightly seal the region at which the upper end of the paper inlet attenuator 50 engages the region surrounding paper inlet slot 11*a*. Thus, any noise emitted through the paper inlet slot 11*a* and attempting to move outwardly from enclosure 11 is prevented from "leaking" out into the atmosphere through the jointure between the guideway slot 40 and the printer mechanism enclosure 11 and is confined to moving along passageway 40 so as to be attenuated to thereby reduce the level of noise emitted from the printer system 10 to the surrounding region.

Turning to a consideration of FIGS. 1, 4 and 5*a*–5*c* and 6, the paper outlet attenuator 80 may be seen to be comprised of a lower paper guide extender sheet 81 and an upper paper outlet attenuator cover member or enclosure 82. Lower paper guide extender sheet 81 may be formed of a suitable metallic or plastic sheet joined to the rear wall 11*c* of printer mechanism enclosure 11 by means of a pair of supporting brackets 83 and 84, having diagonally aligned portions 83*a* and 84*a* for joining the side edges 81*b*, 81*c* of sheet 81 thereto. The free ends 83*b*, 83*c* and 84*b*, 84*c* of brackets 83 and 84 are provided with eyelets 83*d*, 83*e* and 84*d*, 84*e* (see FIG. 6) for receiving fastening means (not shown) to secure the brackets 83, 84 to the rear wall 11*c* of the printer mechanism enclosure 11. Similar fastening means may be provided to join sheet 81 to the diagonally aligned portions 83*a* and 84*a* of brackets 83 and 84. Obviously, any other suitably fastening members and/or techniques may be employed. The upper edge 81*a* of sheet 81 is positioned just below the lower longitudinal edge of the paper outlet slot 11*b* and an elongated strip of resilient acoustic foam material 91 is preferably provided between the lower longitudinal edge of paper outlet slot 11*b* and the upper edge 81*a* of sheet 81 to prevent any noise from leaking outwardly between this jointure and into the atmosphere. Static eliminator means (not shown) may be draped across the sheet 81 to remove static from the paper 16 without affecting the feeding of the paper web 16.

The upper member 82 of the paper outlet attenuator 80 is shown best in FIGS. 5*a*–5*c* and is comprised of a single sheet forming upper surface 82*a* and being bent to form side flanges 82*b* and 82*c*. The upper end of sheet portion 82*a* is bent at 82*d*, while the lower end is bent at 82*e* to form an upper tapered portion and a lower truncated tapered portion. The topmost end of diagonally aligned portion 82*d* is bent to form a pair of mounting clips 82*f* and 82*g* which are adapted to be slidably received within a pair of horizontally aligned slots 11*e* and 11*f* respectively in the rear surface 11*c* of the printer mechanism enclosure 11 and arranged on opposite sides of paper outlet slot 11*b*. The interior surface of top sheet member 82*a* is provided with a pair of substantially Z-shaped clips 92 and 93, each having a flange 92*a* and 93*a* secured to the interior surface of central sheet member 82*a*, an intermediate upright portion 92*b* and 93*b* extending upwardly from member 82*a*, and a flange 92*c* and 93*c* arranged at right angles to the intermediate portion 92*b* and 93*b* and having a permanent magnet member 86*a* and 86*b* secured thereto. The magnet members 86*a*, 86*b* are arranged to be magnetically attractive to the surface of lower paper guide extender sheet 81 and serve, together with clips 82*f* and 82*g* to releasably secure the upper paper guide member 82 to the lower paper guide extender sheet 81.

A sheet 87 of acoustic foam is secured to the inner surface of the upper paper guide member 82 so as to confront the paper web 16 moving therethrough. The foam sheet 87 may be of a design similar to or identical to that employed in the paper inlet attenuator 50.

The flanges of side walls 82*b* and 82*c* extend below the sides 81*b* and 81*c* of lower paper guide extender sheet 81 so as to enclose the guideway 94 on four sides. The interior surfaces of side walls 82*b* and 82*c* may also be fitted with foam sheets 87*a* and 87*b* to further attenuate the sound along the side edges of the guideway 94. As was described hereinabove, the width or gap of the guideway 94 is preferably in the range from 3/16 inch to 1¼ inches, more preferably in the range from ¼ inch to ¾ inches, and most preferably in the range from ¼ inch to 9/16 inch. If desired, further noise attenuation may be achieved by placing an additional foam sheet 87' along the upper surface of lower paper guide extender sheet 81. The length of the guideway 94 is preferably of the order of 10 to 15 inches, and more preferably of the order of 11 to 13 inches in order to provide a significant sound attenuation, while at the same time allowing free, unimpeded movement of the paper web 16 therethrough.

A strip 90 of suitable resilient acoustic foam material may be secured to edge 82*h* or rear wall 11*c* to be positioned above the upper longitudinal edge of paper outlet slot 11*b* so as to provide an effective sound-tight seal between strip 90 and upper edge 82*h* of upper paper guide member 82 to confine any noise emitted through the outlet paper slot 11*b* to pass through the guideway 94 and out of its lower outlet end 95 whereupon the length of the guideway 94, coupled with the sound attenuating capability of the foam sheet (or sheets) 87, 87' serves to significantly reduce noise level at the outlet end 95. Although the lower guide extender sheet 81 is preferably permanently mounted to the rear of the printer housing 11, the upper member 82 may be very simply and easily removed and replaced to facilitate inspection, removal and insertion of a paper web 16.

The effectiveness of the paper inlet and paper outlet attenuators 50, 80 is quite significant. Experimentation has shown that a Centronics band printer of the Series 6600 type with no attenuators generates a noise level of the order of 80 dbA. Attachment of the attenuators 50, 80 reduced the noise level to 68 dbA.

Another further significant reduction in airborne noise has resulted from a printer mechanism enclosure design for enclosure 11 wherein the enclosure 11 has been reduced in overall dimensions so as to tightly fit the mechanism provided therein. The interior surfaces of housing 11 are then covered with an acoustic treatment having a capability of sound absorption, and, hence, attenuation. One preferred acoustic material is lead-lined foam, i.e., an acoustic foam coated with a lead sheathing, a thickness of the order of 20/1000 inch. The lead lining is positioned against the housing interior surface and serves to prevent the transmission of sound which would otherwise reach the walls of the enclosure 11 and thereby be transferred to the exterior of the housing 11. Attenuation is significantly enhanced by placing the sound absorbing material as close as possible to the printer mechanism 18, this being accomplished by reducing the overall dimensions of the enclosure 11. Although the enclosure wall is shown as having a window for example 96 (see FIG. 4) which obviously must be free of any sound deadening material, all other interior surfaces of the enclosure 11 are coated with the sound absorbing sheets, 97 (see FIG. 1*a* ) which are positioned as close to the mechanism 18 as is possible without interfering with the operation of the components within the housing 11.

It can be seen from the foregoing that the paper inlet and paper outlet attenuators, 50, 80 together with the printer mechanism enclosure 11, employ a minimal amount of material while, at the same time, significantly reducing airborne noise without the need for providing an otherwise large and expensive enclosure to completely incarcerate the printer mechanism 18, paper supply box 17 and the lower outlet paper guide extender sheet 81 and paper basket 23. In addition to being expensive from the viewpoint of both the amount of material required and the amount of care required to deaden a large housing and all openings and/or windows provided therein, it is extremely bulky and occupies a lot of additional volume than is required by the design of the present invention.

Although this invention has been described with respect to its preferred embodiments, it should be understood that many variations and modifications will not be obvious to those skilled in the art, and it is preferred, therefore, that the scope of the invention be limited, not by the specific disclosure herein, but only by the appended claims.

What is claimed is:

1. Sound attenuator apparatus for a printer mechanism including an enclosure housing for enclosing the printer mechanism and having a paper inlet slot for introducing paper into the enclosure housing, said sound attenuator apparatus comprising:

a paper inlet attenuator for the paper inlet slot of the enclosure housing, said paper inlet attenuator forming an elongated guideway having a guideway inlet opening for introducing paper into said guideway and a guideway outlet opening for communicating with the paper inlet slot in the enclosure housing for enabling paper to pass through said guideway and into the enclosure housing;

mounting means for mounting said paper inlet attenuator relative to the enclosure housing so that said guideway outlet opening is adjacent the paper inlet slot;

at least one surface of said guideway confronting the surface of the paper being fed therethrough being covered with sound attenuating means for absorbing and attenuating sound; and acoustic attenuating means arranged between said guideway outlet opening and the paper inlet slot in the enclosure housing for controlling the sound level at the region between said paper inlet attenuator and the enclosure housing to prevent noise which is generated within the enclosure housing and emitted through the paper inlet slot from being emitted at the region of said paper inlet slot, and for causing the noise instead to be directed through said guideway to said guideway inlet opening and thereby be attenuated.

2. The sound attenuator apparatus of claim 1 wherein said mounting means comprises means for releasably mounting said paper inlet attenuator relative to the enclosure housing so that said paper inlet attenuator is removable.

3. The sound attenuator apparatus of claim 2 wherein said acoustic attenuating means comprises resilient acoustic foam strips arranged between said paper inlet attenuator and the enclosure housing to circumferentially surround said guideway outlet opening and the paper inlet slot.

4. The sound attenuator apparatus of claim 3 wherein at least a portion of said resilient acoustic foam strips are affixed to said paper inlet attenuator adjacent said guideway outlet opening.

5. Sound attenuator apparatus for a printer mechanism including an enclosure housing for enclosing the printer mechanism and having a paper inlet slot for introducing paper into the enclosure housing, said sound attenuator apparatus comprising:

a printer stand on which the enclosure housing is mounted, said printer stand including a first surface extending from one side of the paper inlet slot in a direction away from the paper inlet slot;

a paper inlet attenuator for the paper inlet slot of the enclosure housing, said paper inlet attenuator having a second surface for cooperation with said first surface of said printer stand to define an elongated guideway having a guideway inlet opening for introducing paper into said guideway and a guideway outlet opening for communicating with the paper inlet slot in the enclosure housing for enabling paper to pass through said guideway and into the enclosure housing;

releasable mounting means for releasably mounting said paper inlet attenuator relative to said first surface of said printer stand so that said guideway outlet opening is adjacent the paper inlet slot;

at least one of said first and second surfaces being covered with acoustic attenuating means for absorbing and attenuating sound; and said guideway being of a length sufficient to reduce the sound level at said guideway inlet opening of noise which is generated within the enclosure housing and emitted through the paper inlet slot.

6. The sound attenuator apparatus of claim 5 wherein said paper inlet attenuator includes side surfaces extending from said second surface, said side surfaces abutting said first surface of said printer stand when said paper inlet attenuator is mounted relative to said first surface of said printer stand to define substantially closed sides of said elongated guideway.

7. The sound attenuator apparatus of claim 5 wherein said releasable mounting means comprise magnetic means for magnetically attracting said paper inlet attenuator to said first surface of said printer stand for releasably magnetically coupling said paper inlet attenuator to said printer stand.

8. The sound attenuator apparatus of claim 7 wherein said first surface of said printer stand extends vertically downward from the paper inlet slot.

9. The sound attenuator apparatus of claim 5 wherein said printer stand forms with the surface of the enclosure housing having the paper inlet slot, a pair of insertion slots positioned beyond the opposite ends of the paper inlet slot; and wherein said paper inlet attenuator includes outwardly projecting insertion flanges at the end of said paper inlet attenuator having said guideway outlet opening, said insertion flanges being slidably movable into said insertion slots to releasably mount said paper inlet attenuator so that said guideway outlet opening is adjacent the paper inlet slot.

10. The sound attenuator apparatus of claim 9 further including acoustic attenuator strips positioned along the end of said paper inlet attenuator adjacent said guideway outlet opening for engaging the enclosure housing about a portion of the paper inlet slot for sealing the region between said paper inlet attenuator and the enclosure housing about the paper inlet slot to minimize sound escaping therebetween and instead to confine the sound noise to egress through said guideway.

11. The sound attenuator apparatus of claim 10 wherein said acoustic attenuator strips comprise resilient acoustic foam strips positioned along the end of said inlet paper attenuator and bridging a longitudinal side and two opposite ends of the paper inlet slot.

12. The sound attenuator apparatus of claim 5 in which the printer mechanism includes an open ended paper supply box having side walls; wherein said releasable mounting means releasably attaches said paper inlet attenuator to said printer stand between the paper supply box and the paper inlet slot; and wherein said paper inlet attenuator further includes a cover portion for covering the open end of the paper supply box and depending side wall portions for extending along the side walls of the paper supply box to reduce the sound level of airborne noise emitted from the printer mechanism.

13. The sound attenuator apparatus of claim 12 wherein said paper inlet attenuator further includes an elongated guide member positioned at said guideway inlet opening for guiding paper from the paper supply box into said guideway inlet opening.

14. The sound attenuator apparatus of claim 13 wherein said guide member is provided adjacent said cover portion of said paper inlet attenuator.

15. Sound attenuator apparatus for a printer mechanism including an enclosure housing for enclosing the printer mechanism and having a paper outlet slot for guiding paper out of the enclosure housing, said sound attenuator apparatus comprising:

a first paper guideway member positioned adjacent one side of the paper outlet slot and extending away therefrom;

a second paper guideway member for forming with said first paper guideway member an elongated guideway having a guideway inlet opening, a guideway outlet opening for emitting paper from said elongated guideway, and substantially closed sides;

means for releasably mounting one of said first and second paper guideway members relative to the enclosure housing so that said guideway inlet opening is adjacent said paper outlet slot so that paper passing from said enclosure housing through said paper outlet slot enters and passes through said elongated guideway to be emitted from said guideway outlet opening;

at least one surface of said first and second guideway members confronting the surface of the paper being fed therethrough being covered with acoustic attenuating means for absorbing and attenuating sound; and said elongated guideway being of a length sufficient to reduce the sound level at said guideway outlet opening of noise generated in the enclosure housing and emitted through said paper outlet slot.

16. The sound attenuator apparatus of claim 15 in which the paper outlet slot has an upper elongated side and a lower elongated side; wherein said first paper guideway member comprises a paper guideway plate extending substantially diagonally downward and away from the lower side of the paper outlet slot to guide the paper out of the enclosure housing and away therefrom; and wherein said second paper guideway member comprises an upper guideway having a central portion and depending side portions for defining the substantially closed sides of said elongated guideway.

17. The sound attenuator apparatus of claim 16 wherein said means for releasably mounting said second paper guideway member comprise mounting clips defined at the end of said second paper guideway member having said guideway outlet opening, and a pair of mounting slots provided on opposite sides of the paper outlet slots on the enclosure housing for releasably receiving said mounting clips and thereby supporting said second paper guideway member on the enclosure housing.

18. The sound attenuator apparatus of claim 17 wherein said means for releasably mounting said second paper guideway member further includes magnetic members mounted on an interior surface of said second paper guideway member for magnetically attracting said paper guideway plate.

19. The sound attenuator apparatus of claim 18 wherein said elongated guideway has a length which is in the range of from six to eighteen inches.

20. The sound attenuator apparatus of claim 19, wherein the length of said elongated guideway is preferably of the order of 10 to 14 inches.

21. The sound attenuator apparatus of claim 19, wherein the length of said elongated guideway is preferably within the range from 11 to 13 inches.

22. The sound attenuator apparatus of claim 14, wherein the surface of said first and second guideway members confronting the surface of the paper being fed therethrough define a gap within the elongated guideway measured in the direction of the thickness of the paper being fed therethrough and wherein said gap is in the range of from ¼ to ¾ inches.

23. The sound attenuator apparatus of claim 22, wherein said gap is preferably within the range from ¼ to 9/16 inches.

24. A printer apparatus comprising:

a printer mechanism for printing on paper;

an enclosure housing for enclosing the printer mechanism and having a paper inlet slot and a paper outlet slot for introducing paper into the enclosure housing and for guiding paper out of said enclosure housing;

a printer stand on which said enclosure housing is mounted, said printer stand including a first surface extending from one side of said paper inlet slot in a direction away from said paper inlet slot;

a paper inlet attenuator for said paper inlet slot, said paper inlet attenuator having a second surface for cooperation with said first surface of said printer stand to define an elongated inlet guideway having a first guideway inlet opening for introducing paper to said inlet guideway and first guideway outlet opening for communicating with said paper inlet slot for enabling paper to pass through said inlet guideway and into said enclosure housing;

first releasable mounting means for releasably mounting said paper inlet attenuator relative to said enclosure housing so that said guideway outlet opening is adjacent said paper inlet slot;

a first paper guideway member mounted to said enclosure housing adjacent one side of said paper outlet slot and extending away therefrom;

a paper outlet attenuator for said paper outlet slot, said paper outlet attenuator comprising a second paper guideway member for forming with said first paper guideway member an outlet guideway having a second guideway inlet opening and a second guideway outlet opening for emitting paper from said outlet guideway;

second releasable mounting means for releasably mounting said second paper guideway member relative to said enclosure housing so that said outlet guideway inlet opening is adjacent said paper outlet slot so that paper passing from said enclosure housing through said paper outlet slot enters and passes through said outlet guideway to be emitted from said second guideway outlet opening;

acoustic attenuating means for said inlet and outlet guideways for absorbing and attenuating sound; and said inlet and outlet guideways each being of a length sufficient to reduce the sound levels at said first guideway inlet opening and said second guideway outlet opening respectively of noise which is generated within the enclosure housing and emitted through said paper inlet and outlet slots.

25. The sound attenuator apparatus of claim 24 wherein said enclosure housing substantially completely encloses said printer mechanism; wherein said enclosure housing includes a window opening for enabling an operator to view the paper passing through the printer mechanism, said window opening being covered with a transparent window secured within said window opening; and the remaining interior surfaces of said printer mechanism enclosure, except for said window opening, being lined with a sound absorbing material for absorbing sound generated within said enclosure housing.

26. The sound attenuator apparatus of claim 25 wherein the dimensions of said enclosure housing are slightly greater than said printer mechanism enclosed therein in order to place the sound absorbing material as close as possible to said printer mechanism for increasing the effectiveness of said sound absorbing material.

27. The sound attenuator apparatus of claim 26 wherein said sound absorbing material comprises lead-lined acoustic foam.

28. A sound attenuator apparatus for a printer mechanism including an enclosure housing for enclosing the printer mechanism and having a paper outlet slot for guiding paper out of the enclosure housing, said sound attenuator apparatus comprising:

a paper outlet attenuator for the paper outlet slot of the enclosure housing, said paper outlet attenuator forming an elongated guideway having a guideway inlet opening for communicating with the paper outlet slot in said enclosure housing for enabling paper to pass through said paper outlet slot and into said elongated guideway, and a guideway outlet opening for emitting paper from said elongated guideway;

mounting means for mounting said paper outlet attenuator relative to the enclosure housing so that said guideway inlet opening is adjacent the paper outlet slot;

at least one surface of said elongated guideway confronting the surface of the paper being fed therethrough being covered by sound attenuating means for absorbing and attenuating sound; and acoustic attenuating means arranged between said guideway inlet opening and the paper outlet slot in the enclosure housing for controlling the sound level at the region between said paper outlet attenuator and the enclosure housing to prevent noise which is generated within the enclosure housing and emitted through the paper outlet slot from being emitted at the region of the paper outlet slot, and for causing the noise instead to be directed through said guideway to said guideway outlet opening and thereby be attenuated.

29. The sound attenuator apparatus of claim 28 wherein said mounting means comprises means for releasably mounting said paper outlet attenuator relative to the enclosure housing so that said paper outlet attenuator is removable.

30. The sound attenuator apparatus of claim 29 wherein said acoustic attenuating means comprises resilient acoustic foam strips arranged between said paper outlet attenuator and the enclosure housing to circumferentially surround said guideway inlet opening and the paper outlet slot.

* * * * *